United States Patent [19]

Smith

[11] 4,171,803

[45] Oct. 23, 1979

[54] KARATE PRACTICE BREAKING BOARD

[76] Inventor: Roger D. Smith, P.O. Box 151, Okoboji, Iowa 51355

[21] Appl. No.: 832,094

[22] Filed: Sep. 12, 1977

[51] Int. Cl.[2] ..... A63B 69/00

[52] U.S. Cl. ..... 272/76; 248/509; 269/160

[58] Field of Search ..... 272/76, 77, 78; 73/856, 73/859, 860, 379; 269/160, 126, 127, 296; 144/278 R, 307; 224/42, 38, 42.1 G, 42.1 F; 248/500, 505, 507, 509, 680, 681; 273/74

[56] References Cited

U.S. PATENT DOCUMENTS

| | | | |
|---|---|---|---|
| 1,004,987 | 11/1912 | Campbell | 272/76 |
| 4,004,799 | 1/1977 | Kundert | 272/76 |
| 4,052,056 | 10/1977 | Friedenthal | 272/76 |

FOREIGN PATENT DOCUMENTS

| | | | |
|---|---|---|---|
| 2622491 | 12/1977 | Fed. Rep. of Germany | 272/76 |
| 1420471 | 11/1965 | France | 272/76 |
| 161716 | 4/1921 | United Kingdom | 273/74 |

OTHER PUBLICATIONS

Biltuff's Versa-Target, p. 40, Black Belt Magazine, Aug. 1974.

"Power Fist" Board Holder, p. 18, Black Belt Magazine, Jan. 1976.

*Primary Examiner*—Richard C. Pinkham
*Assistant Examiner*—Arnold W. Kramer

[57] ABSTRACT

A device for the practice of the martial art of karate, simulating a board to be broken and comprising a pair of clamp members adapted to simulate the shape of the board to be broken; the clamps are adapted to hold pieces of material of varying strength to approximate the varying sizes of board to be broken and a padded striking area may be provided if desired.

4 Claims, 4 Drawing Figures

KARATE PRACTICE BREAKING BOARD

BACKGROUND AND SUMMARY OF THE INVENTION

This invention pertains to the martial art of karate and more particularly to a device to be used in the practice of one of the exercises of that art.

One of the exercises used in karate is board breaking. In this exercise the person engaged in the exercise strikes a board with his hand or foot and breaks it. Usually the board is held by two accomplices.

The board (or boards) to be broken are of the standard size of approximately 10 inches by 12 inches and are 3/4 inches thick. At various stages, the person may break a single, double, triple or more boards in a stack. The boards are broken along the grain as opposed to across the grain, thus requiring less of a blow than the cross grain.

Because the board or boards are held by accomplices, the accomplice is in a position of some danger of having a board break near the point where he is holding. Further, there is considerable material used up in practice sessions in the form of broken boards. Both problems are multiplied when a double or triple board is to be broken.

By my device, I provide a safe device for the board holders. I also provide a device which can be used with varying strengths of material simulating single, double or triple boards with the use of far less material than if a board or boards were to be used. The device is reusable many times and therefore is more economical also than is the destruction of many pieces of lumber.

FIGURES

DESCRIPTION

Figure 1:
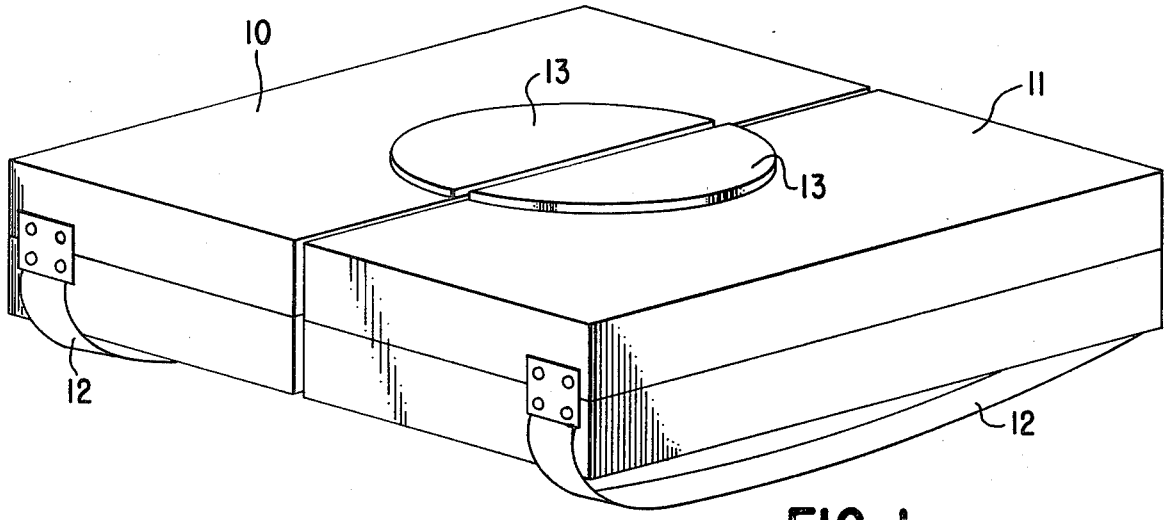
FIG. 1 is a pictorial view of the device of my invention assembled for use.
Figure 2:
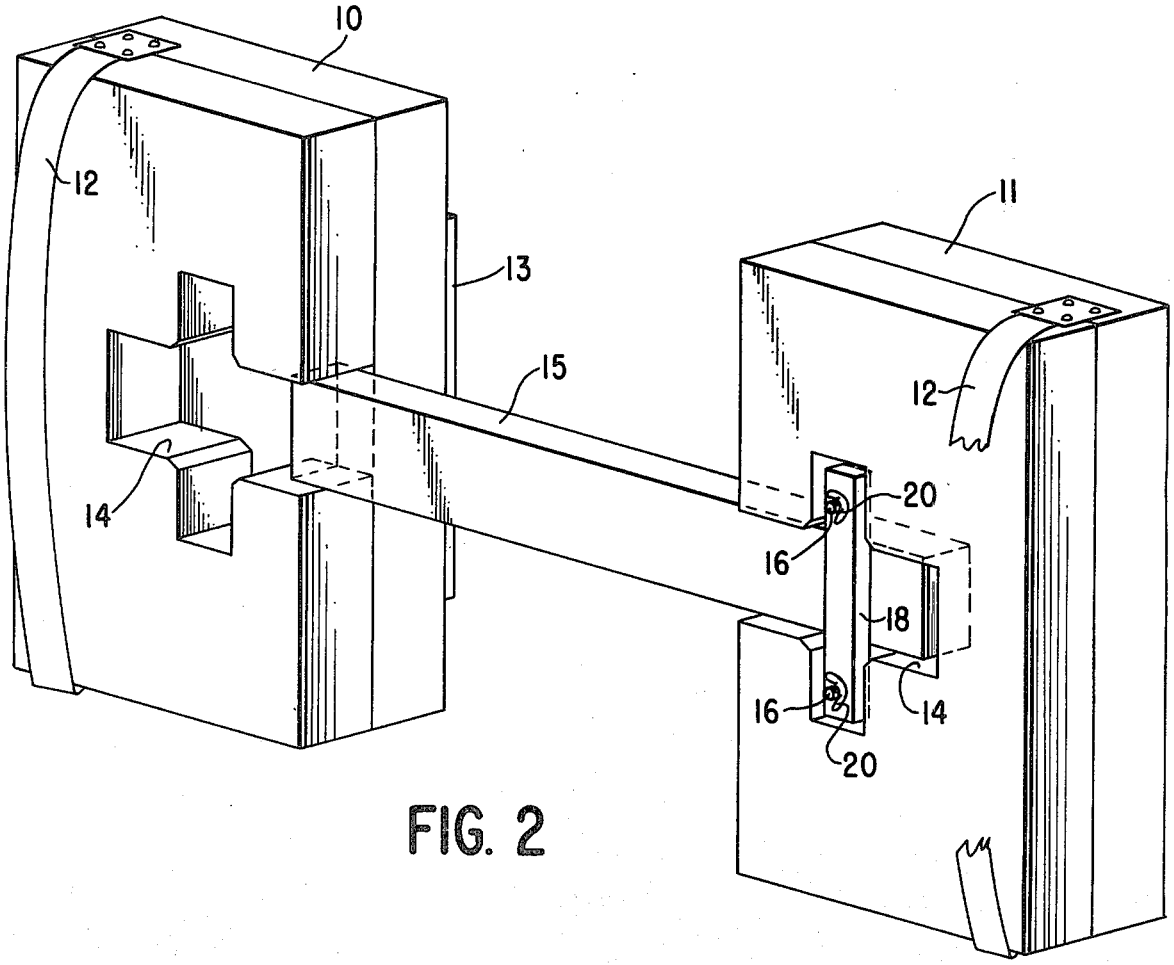
FIG. 2 is a pictorial view from the bottom of my device partially disassembled to show details of the clamp.

Briefly my device comprises a pair of clamping members of a shape and size equal to that of the usual breaking board. A cross-member is clamped firmly between the two members so that it can be broken. Handles may also be provided for ease in holding the device.

More specifically, and referring to the drawings, I provide two similar base members 10 and 11 which are preferably formed of hardwood. These members are mirror images so that one may be a right-hand member and the other a left-hand member. Each includes a handle 12 firmly attached to the member. Padding material on each also forms a target 13 which defines the area to be struck.

Figure 3:
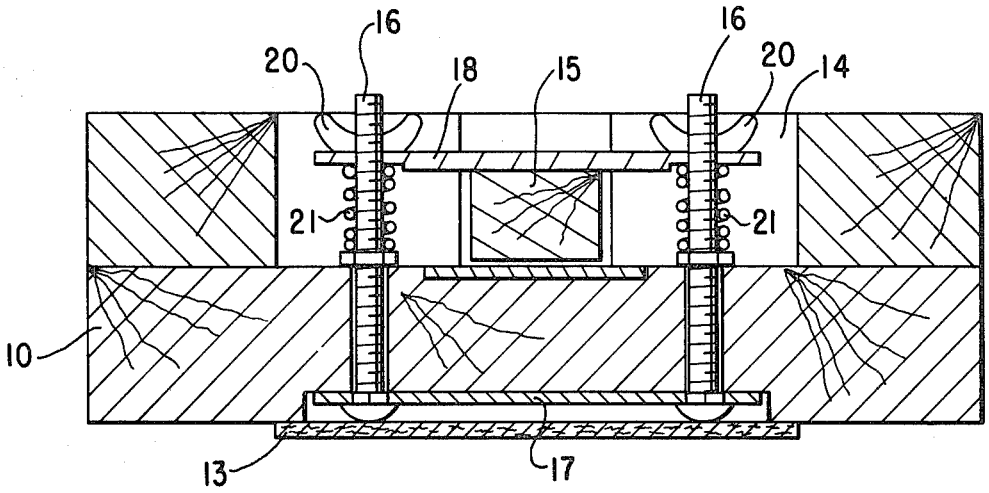
FIG. 3 is a sectional view through one clamping member.

Each base member carries clamping means specifically shown in FIG. 3. This means is recessed into a cross-shaped cut-out 14 formed in each member. For ease of forming, I prefer to make the members of two pieces of board laminated together. One of the pieces is cut out to provide the necessary cross-shaped opening 14 while the other piece is left flat. However, it will be obvious that the member could be a single piece routed out to the necessary shape.

A frangible member 15 is the form of a strip of wood extends between the right hand and left hand members and lies in one arm of the cut-out 14 in each member. This frangible strip 15 may be of varying sizes calibrated to equal the strength of a single, double or triple breaking board. This is accomplished principally by varying the thickness of the strip 15, but in any case, the cut-out 14 must be of proper dimensions to accommodate the various sizes of strip.

The clamping means includes bolts 16 extending through the base members 10 and 11. The heads of these bolts may be recessed into the upper surface of the base members as shown in FIG. 3 and may extend through a plate 17 or similar washer to prevent crushing of the board beneath the head. This obviously will provide firmer clamping onto the strip 15. A clamping plate 18 is adapted to slide over the bolts 16 and to be clamped down onto the strip 15 by the use of wing-nuts 20. Compression springs 21 may be provided to bias the plate 18 to an open position in which the strip 15 may be readily inserted, and against which the plate is clamped onto the strip. Although I have described the clamping means as using washers or a plate 17 or the like, and using springs 21, it is altogether possible to dispense with these means if the basic wood is hard enough to avoid crushing. If the springs are eliminated, some of the depth of the cross channel may also be unnecessary.

Figure 4:
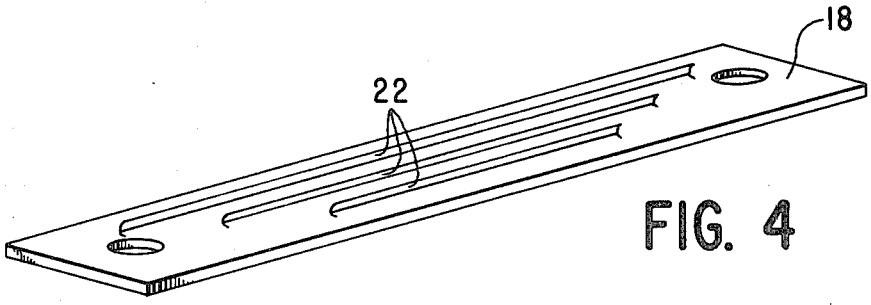
FIG. 4 is a detailed view of the clamping plate.

In order to operate with reasonably accurate approximation of the correct strength, the strip 15 must be securely clamped. Therefore, I provide each clamping plate 18 with a series of ridges 22 (FIG. 4) which can be clamped down firmly on the strip. It will be apparent that other forms of raised irregularities such as raised bosses on the plates could be used to provide the same effect.

The strip 15 is preferably a soft wood strip of a size calibrated to require the same force to break cross-grain as would a breaking board (single, double, triple, or greater) to break parallel to the grain. Thus, a strip 15 of one proportion would simulate a single breaking board, one somewhat larger would simulate a double board, etc.

In use, the proper strip 15 would be clamped in each of two matching base members 10 and 11 leaving a proper space between the members so that the strip can be broken. The space may be varied, to some extent, dependent on the thickness of the strip 15. Two assistants hold the two members by the handles 12 while the practicer strikes the target 13 and breaks the strip. The break, if it occurs, is always between the two base members, so there is no problem to the holders after the blow about a narrow strip being held by one and a wide piece by the other as may sometimes happen when using a breaking board. It is also clear that only small amounts of wood will be required for the various strips 15 as opposed to the sizable amounts required to provide full breaking boards each time one is broken. Thus there are real economies to be achieved by my device.

I claim:

1. A breaking board simulator comprising a pair of base members, clamping means in each of said base members, each clamping means including a pair of bolts extending through said base members, a clamping plate slidably mounted on said bolts, strip means held between said clamping plate and said base member at opposing edges of said strip means whereby said pair of base members is joined together, nut means on each bolt to clamp said plate and base member around said strip means, said strip means being proportioned to provide a breaking strength simulating that of a breaking board.

2. The device of claim 1 in which said clamping plate is formed with surface irregularities in the area of engagement with said strip to provide more secure clamping.

3. The device of claim 1 in which said base members are formed with recesses in which said strip and said clamping means are recessed.

4. The device of claim 1 in which a padded target means is provided on one face of each base member.

* * * * *